US012139365B2

(12) United States Patent
Nakamura

(10) Patent No.: US 12,139,365 B2
(45) Date of Patent: Nov. 12, 2024

(54) ROLL SUPPORT DEVICE

(71) Applicant: FUJITSU FRONTECH LIMITED, Inagi (JP)

(72) Inventor: Hirokatsu Nakamura, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 310 days.

(21) Appl. No.: 17/829,926

(22) Filed: Jun. 1, 2022

(65) Prior Publication Data

US 2022/0289517 A1 Sep. 15, 2022

Related U.S. Application Data

(63) Continuation of application No. PCT/JP2019/050222, filed on Dec. 20, 2019.

(51) Int. Cl.
*B65H 75/12* (2006.01)
*B65H 75/18* (2006.01)
*B65H 75/22* (2006.01)

(52) U.S. Cl.
CPC ..... *B65H 75/12* (2013.01); *B65H 75/185* (2013.01); *B65H 75/22* (2013.01)

(58) Field of Classification Search
CPC ..... B65H 16/04; B65H 23/032; B65H 75/12
USPC ..... 242/548.3
See application file for complete search history.

(56) References Cited

U.S. PATENT DOCUMENTS 5,087,318 A * 2/1992 Anderson ..... B65H 39/16 156/543
6,302,604 B1 * 10/2001 Bryant ..... B65H 23/02 242/597.5
9,573,718 B2 * 2/2017 Austermeier ..... B65H 75/28
10,323,929 B1 * 6/2019 Wong ..... B65H 16/00
2013/0126664 A1 * 5/2013 Hitz ..... B65H 16/005 242/597.3
2013/0272767 A1 * 10/2013 Tanaka ..... B65H 16/04 242/597
2018/0154662 A1 * 6/2018 Ho ..... B41J 15/046
2021/0402804 A1 * 12/2021 Sugiura ..... B41J 15/042
(Continued)

FOREIGN PATENT DOCUMENTS

JP 8-133540 A 5/1996
JP 10-181964 7/1998
(Continued)

OTHER PUBLICATIONS

Chinese Office Action mailed on Jan. 23, 2024 for the corresponding Chinese patent application No. 201980102897.X.
(Continued)

*Primary Examiner* — William A. Rivera
(74) *Attorney, Agent, or Firm* — STAAS & HALSEY LLP

(57) ABSTRACT

A roll support device includes: a shaft portion that supports a center hole of a rolled medium in which a medium is wound; a first guide member with which one end surface of the rolled medium in an axial direction of the shaft portion is in contact; a second guide member that is provided on the shaft portion and regulates, in the axial direction, an inner peripheral side of another end surface of the rolled medium in the axial direction; and a third guide member that regulates, in the axial direction, an outer peripheral side of the other end surface of the rolled medium supported by the shaft portion.

8 Claims, 11 Drawing Sheets

(56) References Cited

U.S. PATENT DOCUMENTS

| | | | | |
|---|---|---|---|---|
| 2023/0033033 | A1* | 2/2023 | Wehrmann | B41J 15/165 |
| 2024/0140113 | A1* | 5/2024 | Nomura | B65H 23/08 |

FOREIGN PATENT DOCUMENTS

| | | |
|---|---|---|
| JP | 2000-351493 | 12/2000 |
| JP | 2006-315791 | 11/2006 |

OTHER PUBLICATIONS

International Search Report, dated Feb. 4, 2020, in International Patent Application No. PCT/JP2019/050222 (5 pp.).
Written Opinion of the International Searching Authority, dated Feb. 4, 2020, in International Patent Application No. PCT/JP2019/050222 (4 pp.).
CN Office Action dated Jun. 26, 2024 for the corresponding Chinese Patent Application No. 201980102897.X.

* cited by examiner

ROLL SUPPORT DEVICE

CROSS-REFERENCE TO RELATED APPLICATION

This application is a continuation application of International Application PCT/JP2019/050222, filed on Dec. 20, 2019 and designating the U.S., the entire contents of which are incorporated herein by reference.

FIELD

The present invention relates to a roll support device.

BACKGROUND

Some printers for performing printing on long paper include a roll support device that supports a rolled medium such as roll paper obtained by winding long paper. This type of roll support device includes a pair of guide members that sandwich and regulate both end surfaces of a rolled medium as a support structure for supporting the rolled medium. In this type of roll support device, at the time of replacing the rolled medium, one guide member regulates one end surface of the rolled medium while the other guide member is attached to the other end surface of the rolled medium.

Patent Literature 1: JP 2006-315791 A

In the above-described roll support device, replacement of a rolled medium accompanies an operation of attaching/detaching a guide member to/from an end surface of the rolled medium. The operation of attaching/detaching the rolled medium is complicated. In addition, the guide member, which is detached at the time of detachment, may be lost.

SUMMARY

According to an aspect of the embodiments, a roll support device disclosed in the present application includes: a shaft portion that supports a center hole of a rolled medium in which a medium is wound; a first guide member with which one end surface of the rolled medium in an axial direction of the shaft portion is in contact; a second guide member that is provided on the shaft portion and regulates, in the axial direction, an inner peripheral side of another end surface of the rolled medium in the axial direction; and a third guide member that regulates, in the axial direction, an outer peripheral side of the other end surface of the rolled medium supported by the shaft portion.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Embodiments of a roll support device disclosed in the present application will be described in detail below with reference to the drawings. Note that the following embodiments do not limit the roll support device disclosed in the present application.

First Embodiment

Figure 1:
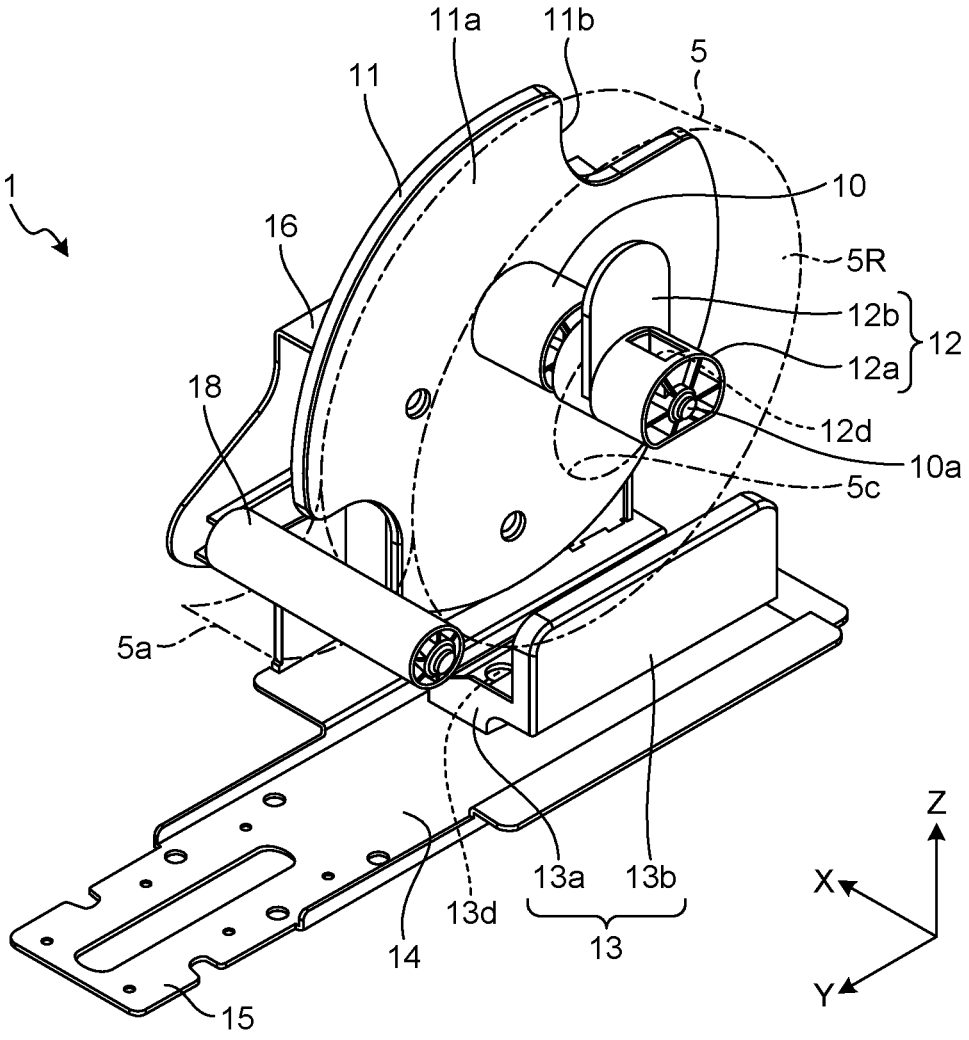
FIG. 1 is a perspective view illustrating a roll support device of a first embodiment from a right side.
Figure 2:
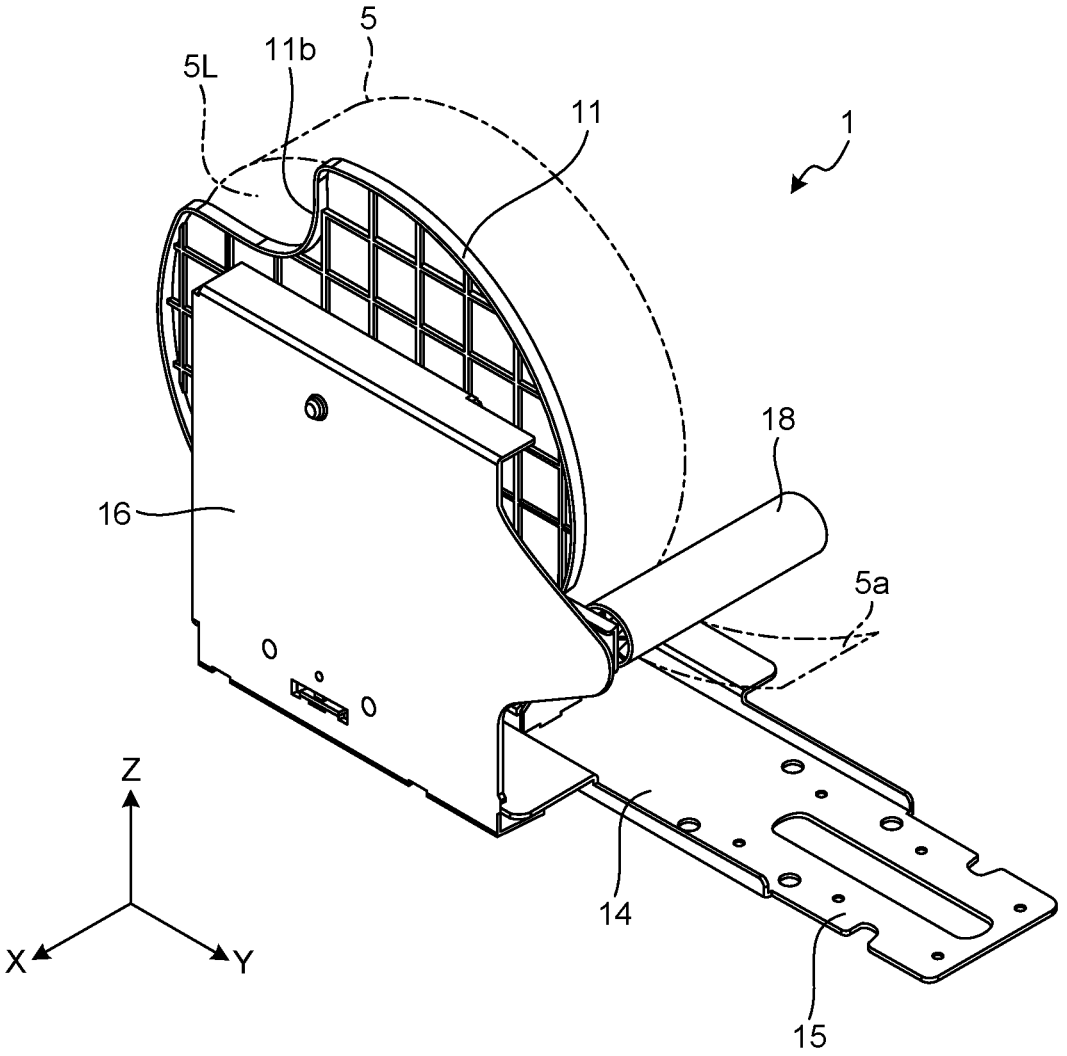
FIG. 2 is a perspective view illustrating the roll support device of the first embodiment from a left side.

FIG. 1 is a perspective view illustrating a roll support device of a first embodiment from a right side. FIG. 2 is a perspective view illustrating the roll support device of the first embodiment from a left side.

As illustrated in FIGS. 1 and 2, a roll support device 1 of the first embodiment rotatably supports roll paper 5, which is a rolled medium, and is used for supplying long paper, which is a medium wound in the roll paper, from the roll paper to a printer (not illustrated). The roll support device 1 is disposed so as to be connected to the side of a paper feed port of the printer.

In FIG. 1 and subsequent figures, the width direction of the roll support device 1, the longitudinal direction of the roll support device 1, and the height direction of the roll support device 1 are indicated as an X direction, a Y direction, and a Z direction, respectively. The width direction X of the roll support device 1 is an axial direction along the center axis of a center hole 5*c* of the roll paper 5, which is supported by the roll support device 1, that is, the width direction of the roll paper 5. The longitudinal direction Y of the roll support device 1 is a supply direction in which long paper 5*a* is drawn out from the roll paper 5.

The roll support device 1 of the present embodiment is used for supplying long paper to a printer that issues baggage tags and boarding passes, for example. The baggage tags are attached to baggage in an airport. The boarding passes record a flight number, a seat number, and the like of an aircraft of a passenger. Note that the roll support device 1 of the present embodiment is not limited to use of supporting roll paper for issuing the baggage tags and the boarding passes, and may be applied to support roll paper for creating tags such as various baggage tags and price tags, business forms, and the like.

The roll paper 5 is formed by winding long paper 5*a* around a core 5*b*. The long paper 5*a* has a so-called tape shape in which the roll paper 3 has a narrow dimension in the width direction (Y direction). In the present embodiment, for example, the roll paper 5, which has an outer diameter of approximately 200 [mm] or less and an outer diameter of the core 5*b* of approximately 80 mm, is used. Note that the roll paper is not limited to those having the core 5*b*. The roll paper without the core 5*b* may be used. Therefore, the center hole 5*c* of the roll paper 5 in the present embodiment refers to a through hole of the core 5*b* when the roll paper 5 has the core 5*b*, and refers to the center hole of the roll paper 5 itself when the roll paper 5 does not have the core 5*b*. Hereinafter, the center hole 5*c* of the roll paper 5 including the through hole of the core 5*b* of the roll paper 5 will be simply referred to as the center hole 5*c* of the roll paper 5.

Furthermore, although, the roll paper 5, in which the long paper 5*a* is wound around the core 5*b*, is used as the rolled medium in the present embodiment, the rolled medium is not limited to the roll paper 5. For example, label paper obtained by layering a label on release paper, and roll paper, in which a radio frequency identifier (RFID) tag, is embedded may be used as the rolled medium.

(Configuration of Roll Support Device)

Figure 3:
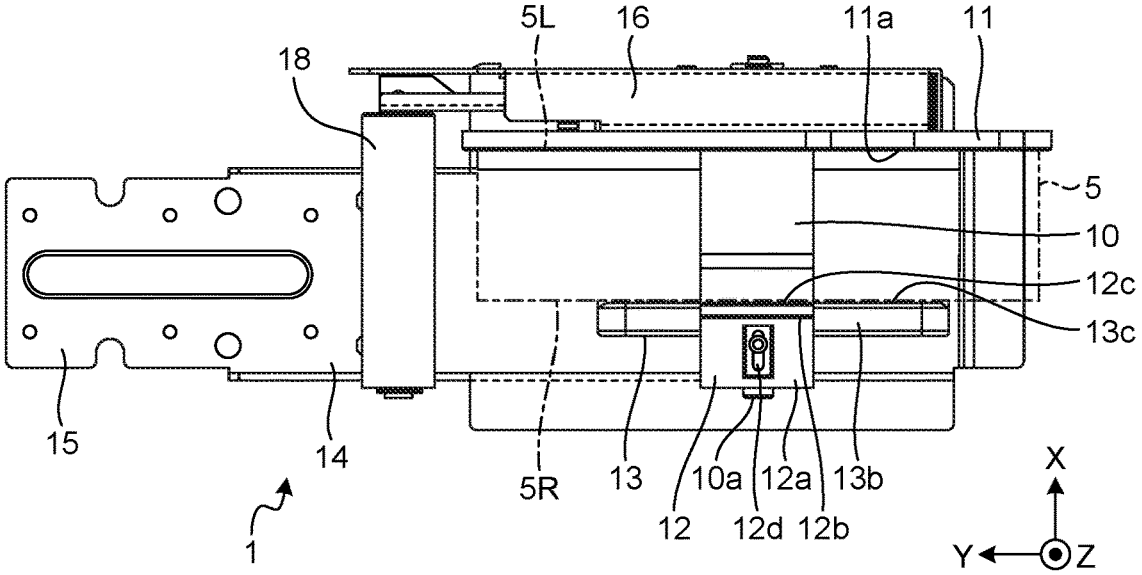
FIG. 3 is a plan view illustrating the roll support device of the first embodiment.
Figure 4:
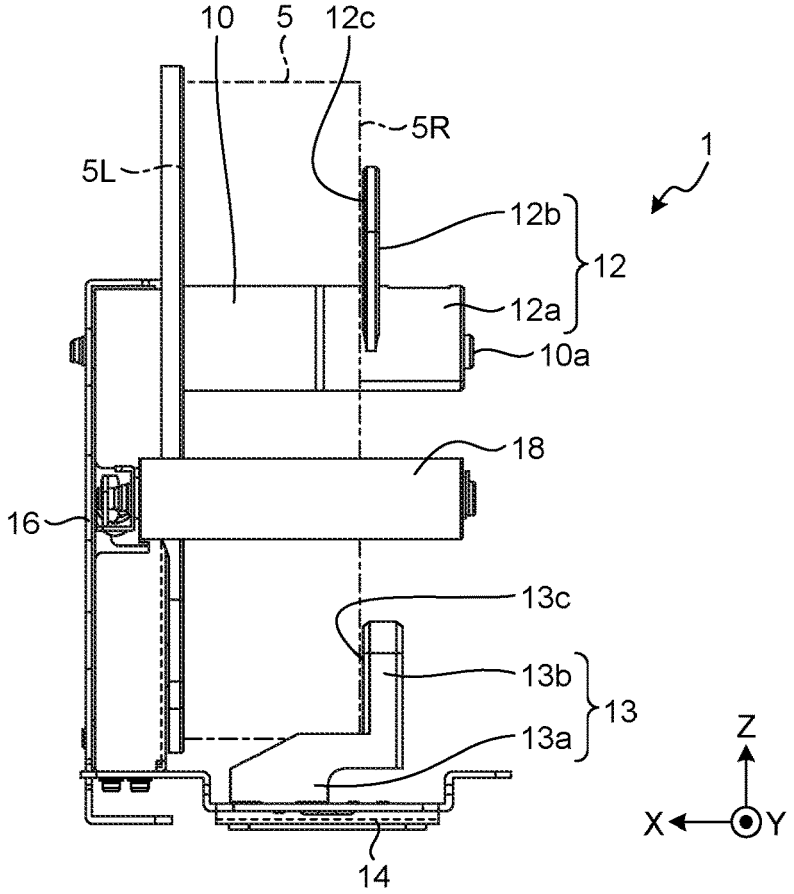
FIG. 4 is a front view illustrating the roll support device of the first embodiment.
Figure 5:
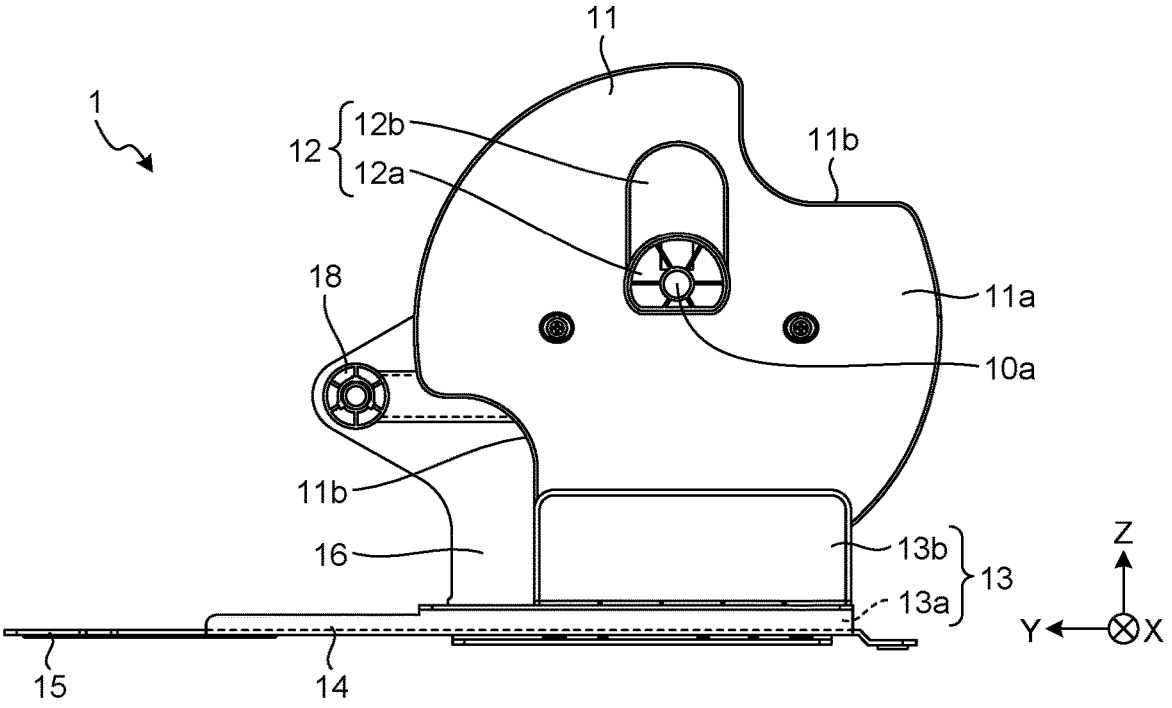
FIG. 5 is a right side view illustrating the roll support device of the first embodiment.
Figure 6:
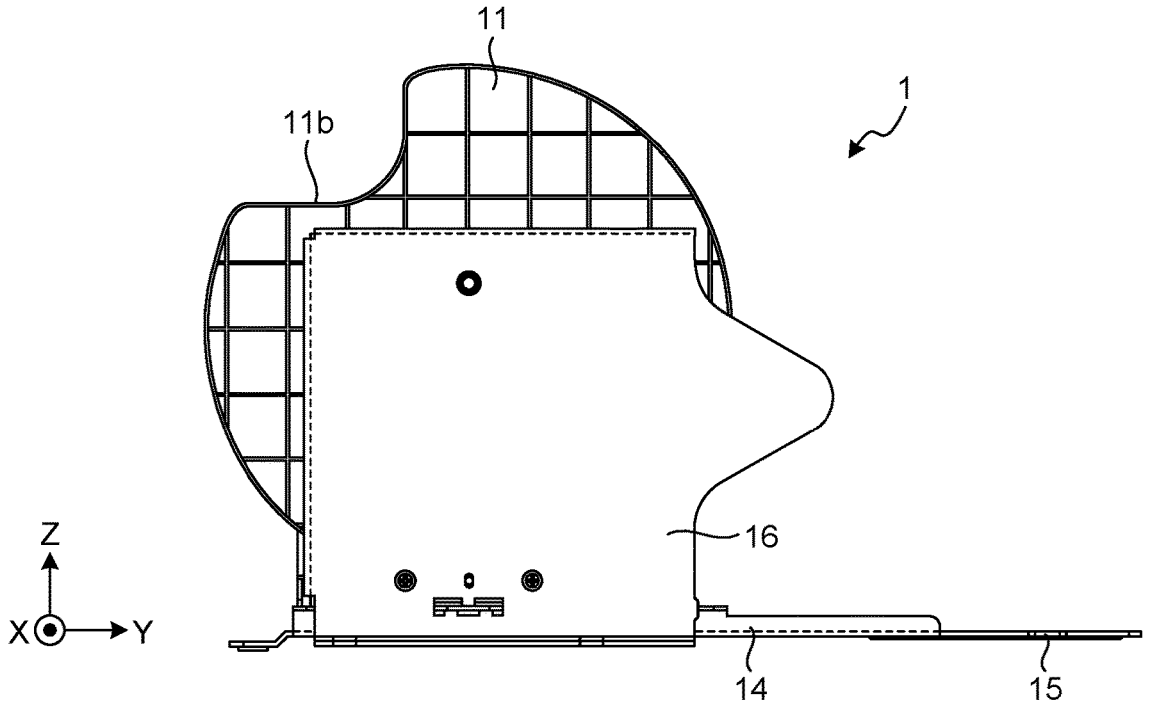
FIG. 6 is a left side view illustrating the roll support device of the first embodiment.

FIG. 3 is a plan view illustrating the roll support device 1 of the first embodiment. FIG. 4 is a front view illustrating the roll support device 1 of the first embodiment. FIG. 5 is a right side view illustrating the roll support device 1 of the first embodiment. FIG. 6 is a left side view illustrating the roll support device 1 of the first embodiment. The front of the roll support device 1 refers to a surface of the roll support device 1 as viewed from a printer side. The left and right sides of the roll support device 1 refer to sides as viewed from the front of the roll support device 1.

As illustrated in FIGS. 1, 2, and 3 to 6, the roll support device 1 of the first embodiment includes a shaft portion 10 and a first guide member 11. The shaft portion 10 supports the center hole 5*c* of the roll paper 5 (through hole of core 5*b*). One end surface 5L (hereinafter, also referred to as left end surface 5L) of the roll paper 5 in the X direction, which is the axial direction of the shaft portion 10 (hereinafter referred to as axial direction X), is in contact with the first guide member 11. Furthermore, the roll support device 1 includes a second guide member 12 and a third guide member 13. The second guide member 12 regulates, in the axial direction X, the inner peripheral side (inner diameter side) of the other end surface 5R (hereinafter, also referred to as right end surface 5R) of the roll paper 5 in the axial direction X. The third guide member 13 regulates, in the axial direction X, the outer peripheral side (outer diameter side) of the other end surface 5R (right end surface 5R) of the roll paper 5, supported by the shaft portion 10.

Furthermore, as illustrated in FIGS. 1, 2, and 3, 4, the roll support device 1 includes a base 14 provided with the shaft portion 10, the first guide member 11, and the third guide member 13. The base 14 is formed of, for example, a metal plate, and includes an attachment portion 15, which is attached to a printer, and a side wall portion 16, which extends in the Z direction.

As illustrated in FIGS. 5 and 6, the first guide member 11 is fixed to the side wall portion 16 by a fastening member such as a screw. A guide roller 18, which guides the feeding direction of the long paper 5*a* drawn out from the roll paper 5, is rotatably provided on the side wall portion 16. The guide roller 18 is provided in parallel with the axial direction X of the shaft portion 10, and includes, for example, a rubber roller.

As illustrated in FIGS. 1, and 3, 4, one end of the shaft portion 10 is fixed to the first guide member 11, and is cantilevered by the first guide member 11. The shaft portion 10 includes a support shaft 10*a* along the axial direction X. The shaft portion 10 support the second guide member 12, by passing the support shaft 10*a* through a shaft hole of the second guide member 12. The shaft portion 10 has an outer diameter of, for example, approximately half the inner diameter of the core 5*b* of the roll paper 5. The shaft portion 10 has a substantially semicircular cross section formed by cutting the lower side of the shaft portion 10 along an X-Y plane. The shaft portion 10 is passed through the center hole 5*c* of the roll paper 5 (through hole of core 5*b*) to support the upper side of an inner peripheral portion of the core 5*b* of the roll paper 5.

As illustrated in FIGS. 1 and 3 to 5, the first guide member 11 has a flat reference surface 11*a*, on which the left end surface 5L of the roll paper 5, supported by the shaft portion 10, abuts. The reference surface 11*a* is formed along the Z direction. As illustrated in FIGS. 1, 2, and 5, 6, the first guide member 11 has a size that substantially covers the left end surface 5L of the roll paper 5. A cut portion 11*b*, which exposes a part of the left end surface 5L on the outer peripheral side, is formed on an outer peripheral portion of the first guide member 11.

The second guide member 12 is detachably provided at an end opposite to the first guide member 11 in the axial direction X of the shaft portion 10. Furthermore, the second guide member 12 is provided so as to be attached in an orientation opposite to the axial direction X of the shaft portion 10. The second guide member 12 includes a fixed portion 12*a*, which is fixed at an end of the shaft portion 10, and a regulation portion 12*b*, which regulates the inner peripheral side of the right end surface 5R of the roll paper 5.

As illustrated in FIGS. 1, and 3, 4, the fixed portion 12*a* of the second guide member 12 has a substantially semicircular cross section, which has the same shape as the shaft portion 10. Furthermore, the fixed portion 12*a* of the second guide member 12 has a long hole 12*d*, which has a long diameter along the axial direction X of the shaft portion 10, and is fixed to the support shaft 10*a* of the shaft portion 10 by a fastening member such as a screw passed through the long hole 12*d*. Therefore, the fixed portion 12*a* is provided so as to adjust the fixing position of the support shaft 10*a* of the shaft portion 10 in the axial direction X. This allows the position of the regulation portion 12*b* in the axial direction X of the shaft portion 10 to be appropriately adjusted in accordance with the width of the roll paper 5 to be used.

As illustrated in FIGS. 1 and 5, the regulation portion 12*b* of the second guide member 12 extends upward from the upper end of the fixed portion 12*a* along the radial direction of the roll paper 5. As illustrated in FIGS. 3 and 4, the regulation portion 12*b* has a flat plate shape, which has a regulation surface 12*c* in contact with the right end surface 5R of the roll paper 5.

Furthermore, the regulation portion 12*b* is disposed such that the position of the regulation portion 12*b* in the axial direction X of the fixed portion 12*a* is closer to one end side in the axial direction X than the center in the axial direction X of the fixed portion 12*a*. Therefore, the position of the regulation portion 12*b* in the axial direction X of the shaft portion 10 can be switched in accordance with the width of the roll paper 5 to be used, by attaching the regulation portion 12*b* in an orientation opposite to the axial direction X of the shaft portion 10 (see FIGS. 10A and 10B).

Furthermore, the upper end of the regulation portion 12*b* in the Z direction has an arc shape along the peripheral direction of the shaft portion 10, so that the regulation portion 12*b* can smoothly pass through the inner peripheral portion of the core 5*b* of the roll paper 5.

The third guide member 13 is disposed on the side of the right end surface 5R of the roll paper 5, supported by the shaft portion 10, and detachably provided on the base 14 below the second guide member 12. Furthermore, the third guide member 13 is provided so as to be attached in an orientation opposite to the axial direction X of the shaft portion 10. As illustrated in FIGS. 1, and 3, 4, the third guide member 13 has a substantially L-shaped cross section, and includes a fixed portion 13*a*, which is fixed on the base 14, and a regulation portion 13*b*, which regulates the outer peripheral side of the right end surface 5R of the roll paper 5.

As illustrated in FIG. 1, the fixed portion 13*a* of the third guide member 13 has a long hole 13*d*, which has a long diameter along the X direction, and is fixed to the base 14 by a fastening member such as a screw passed through the long hole 13*d*. Therefore, the fixed portion 13*a* is provided so as to adjust the fixing position on the base 14 in the axial direction X of the shaft portion 10. Similarly to the second guide member 12, this allows the position of the regulation portion 13*b* in the axial direction X of the shaft portion 10 to be appropriately adjusted in accordance with the width of the roll paper 5 to be used. A regulation surface 13*c* of the third guide member 13 is fixed at a position coinciding with that of the regulation surface 12*c* of the second guide member 12 in the axial direction X of the shaft portion 10.

As illustrated in FIGS. 3 and 4, the regulation portion 13*b* of the third guide member 13 extends upward from the fixed portion 13*a* along the radial direction of the roll paper 5. The regulation portion 13*b* has a flat plate shape, which has the regulation surface 13*c* in contact with the right end surface 5R of the roll paper 5. Furthermore, as illustrated in FIG. 5, the regulation portion 13*b* has a length in the Y direction approximately three times as long as the length in the Y direction of the regulation portion 12*b* of the second guide member 12, and extends in the longitudinal direction (Y direction) of the roll support device 1 with respect to the shaft portion 10.

Furthermore, since the regulation portion 13*b* is disposed at an end of the fixed portion 13*a* in the axial direction X, the position of the regulation portion 13*b* in the axial direction X of the shaft portion 10 can be switched in accordance with the width of the roll paper 5 to be used, by attaching the regulation portion 13*b* in an orientation opposite to the axial direction X of the shaft portion 10.

(Range Regulated by Second Guide Member and Third Guide Member)

Figure 8:
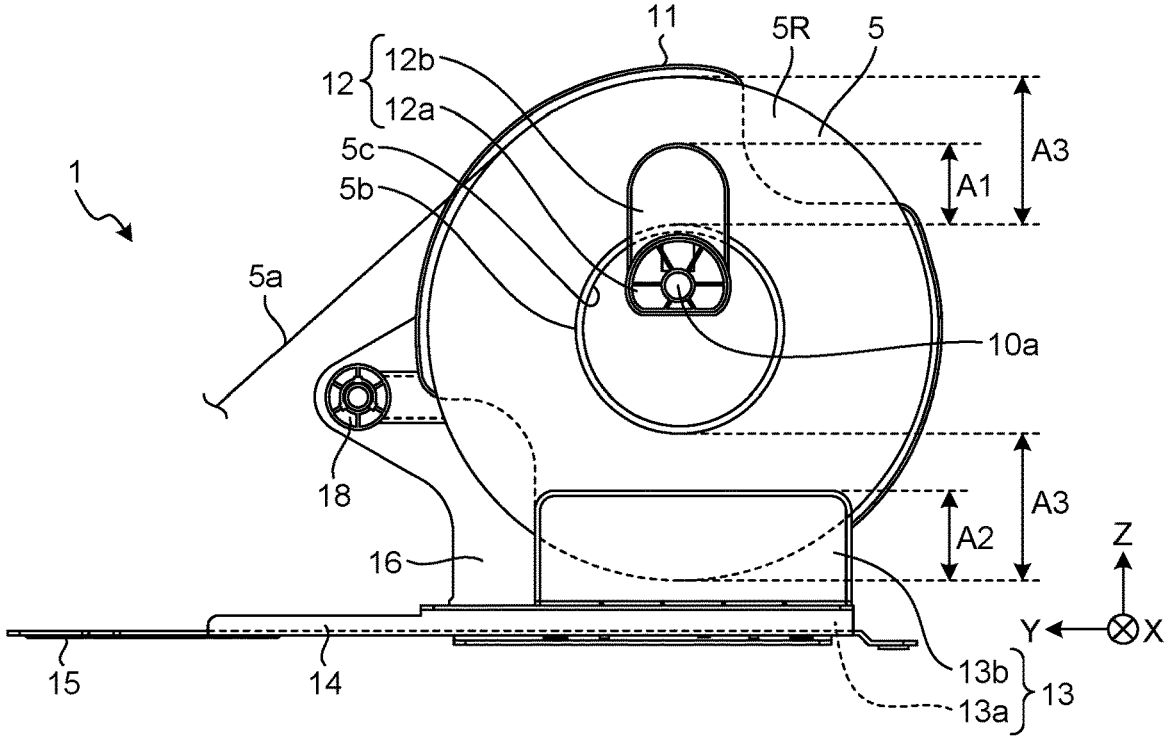
FIG. 8 is a right side view illustrating a state in which the roll paper is supported by the shaft portion of the roll support device of the first embodiment.

In the radial direction of the roll paper 5 supported by the shaft portion 10, the sum of a radial upper range A1 on the inner peripheral side of the right end surface 5R, regulated by the second guide member 12, and a radial lower range A2 on the outer peripheral side of the right end surface 5R, regulated by the third guide member 13, is equal to or larger than an entire range A3 from the inner periphery to the outer periphery of the right end surface 5R of the roll paper 5 (see FIG. 8). That is, the entire range A3 from the inner periphery to the outer periphery in a radial portion of the right end surface 5R of the roll paper 5 is regulated by the cooperation of the regulation surface 12*c* of the second guide member 12 and the regulation surface 13*c* of the third guide member 13. Therefore, in the roll paper 5 supported by the shaft portion 10, the first guide member 11 and the second guide member 12 inhibit the disorder of the roll paper 5 on the inner peripheral side while the first guide member 11 and the third guide member 13 inhibit the disorder of the roll paper 5 on the outer peripheral side, so that the long paper 5*a* can be stably supplied.

(Attachment of Roll Paper)

Figure 7:
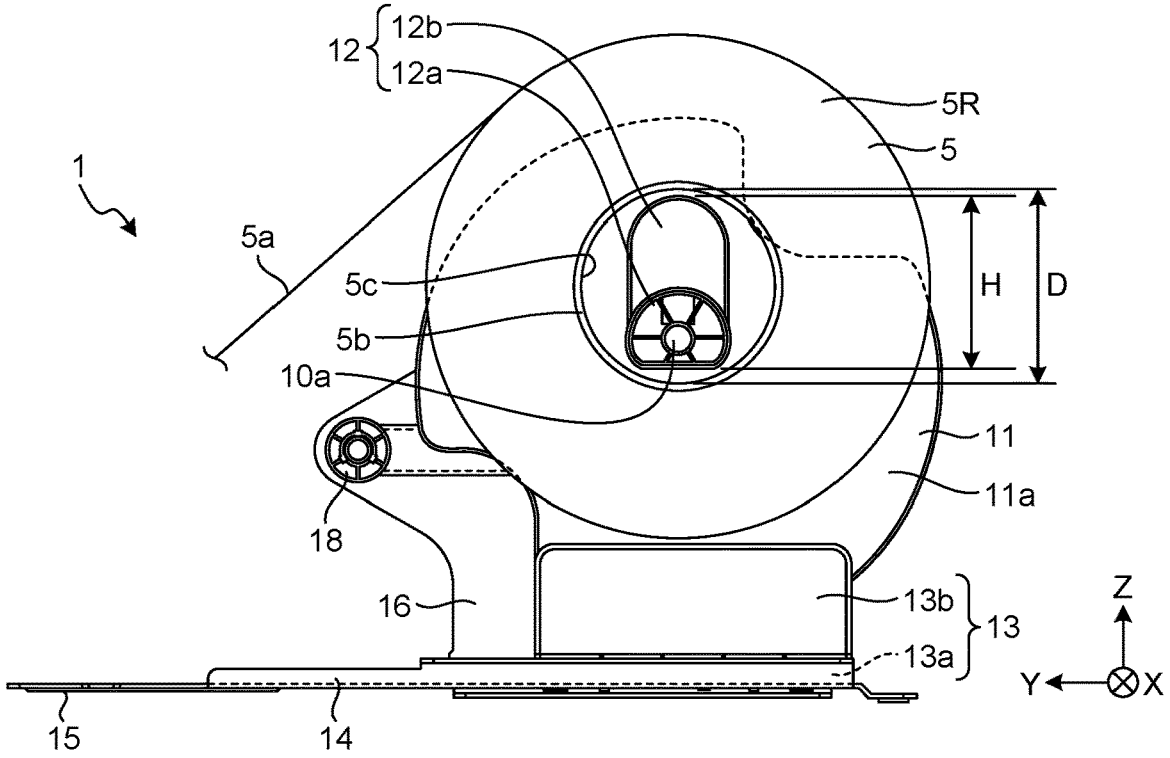
FIG. 7 is a right side view illustrating a state in which a shaft portion of the roll support device of the first embodiment is passed through a center hole of roll paper.
Figure 9:
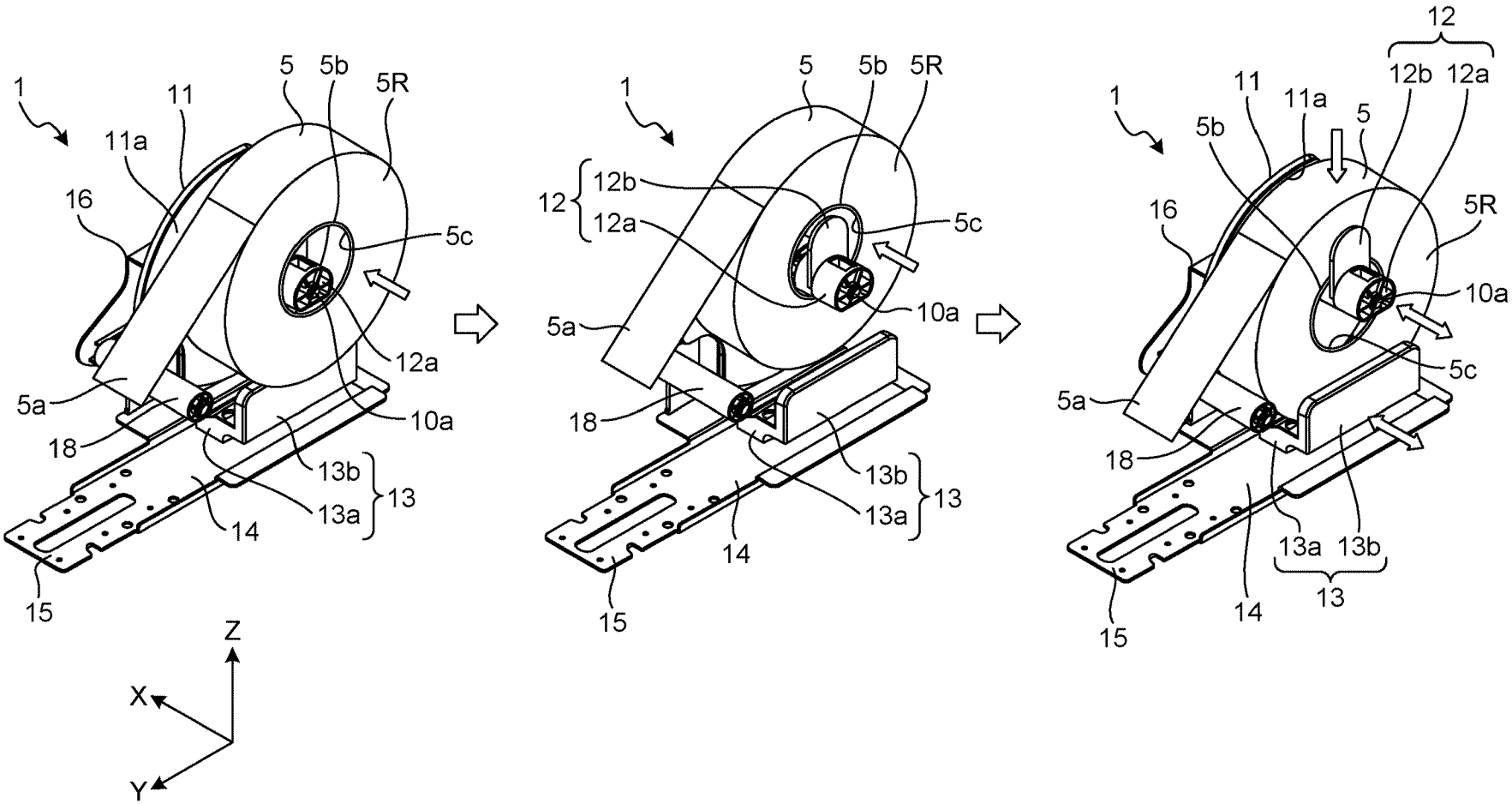
FIG. 9 is a perspective view illustrating a state in which the roll paper is attached to the shaft portion of the roll support device of the first embodiment.

FIG. 7 is a right side view illustrating a state in which the shaft portion 10 of the roll support device 1 of the first embodiment is passed through the center hole 5*c* of the roll paper 5. FIG. 8 is a right side view illustrating a state in which the roll paper 5 is supported by the shaft portion 10 of the roll support device 1 of the first embodiment. FIG. 9 is a perspective view illustrating a state in which the roll paper 5 is attached to the shaft portion 10 of the roll support device 1 of the first embodiment.

As illustrated in FIGS. 7 and 9, a height H of the second guide member 12 in the radial direction of the roll paper 5, supported by the shaft portion 10, is smaller than an inner diameter D of the center hole 5*c* of the roll paper 5 (through hole of core 5*b*). This allows the shaft portion 10 and the second guide member 12 to be easily and smoothly passed through the center hole 5*c* of the roll paper 5.

When the roll paper 5 is attached to the roll support device 1, the shaft portion 10 and the second guide member 12 are passed through the center hole 5*c* of the roll paper 5, and then the left end surface 5L of the roll paper 5 is made to abut on the reference surface 11*a* of the first guide member 11. Subsequently, as illustrated in FIGS. 8 and 9, the roll paper 5 is lowered by the weight of the roll paper 5 itself in the height direction Z with the left end surface 5L of the roll paper 5 being in contact with the reference surface 11*a* of the first guide member 11, so that the center hole 5*c* of the roll paper 5 is supported by the shaft portion 10.

When the center hole 5*c* of the roll paper 5 is supported by the shaft portion 10 as described above, the regulation surface 12*c* of the second guide member 12 is in contact with the inner peripheral side of the right end surface 5R of the roll paper 5 while the regulation surface 13*c* of the third guide member 13 is in contact with the outer peripheral side of the right end surface 5R of the roll paper 5. Therefore, the left end surface 5L of the roll paper 5 whose center hole 5*c* is supported by the shaft portion 10 is regulated by the reference surface 11*a* of the first guide member 11 over the radial direction in the axial direction X. The roll paper 5 is regulated by the regulation surface 12*c* of the second guide member 12 and the regulation surface 13*c* of the third guide member 13 from the inner periphery to the outer periphery of the right end surface 5R in the axial direction X.

The second guide member 12 and the third guide member 13 are attached to the shaft portion 10 of the roll paper 5 in a state of being preliminarily fixed at appropriate positions in the axial direction X of the shaft portion 10 in accordance with the roll paper 5 to be used. The second guide member 12 and the third guide member 13 may be adjusted to appropriate positions in the axial direction X and fixed after the roll paper 5 is supported by the shaft portion 10.

Note that, in one example in FIGS. 7 to 9, when viewed from the right side of the roll support device 1, the roll paper 5 in which the long paper 5*a* is wound counterclockwise is supported, and the long paper 5*a* is drawn out downward from an upper portion of the roll paper 5. The orientation of the roll paper 5 supported by the shaft portion 10 is not limited to the orientation in FIGS. 7 to 9. Although not illustrated, as the orientation of the roll paper 5 supported by the shaft portion 10, when viewed from the right side of the roll support device 1, the roll paper 5 in which the long paper 5*a* is wound clockwise may be supported, and the long paper 5*a* may be drawn out upward from a lower portion of the roll paper 5. Furthermore, the guide roller 18 is disposed such that angles, at which the long paper 5*a* drawn out from the roll paper 5 enters the guide roller 18, are equal to each other even, when the roll paper 5 is supported by the shaft portion 10 in any of the above-described orientations.

Specifically, the guide roller 18 is disposed at a predetermined position to the shaft portion 10 such that an angle, formed by the feeding direction of the long paper 5*a* to a straight line connecting the center of the shaft portion 10 with the center of guide roller 18, in the case where the long paper 5*a* is drawn out from the upper portion of the roll paper 5, is equal to that in the case where the long paper 5*a* is drawn out from the lower portion of the roll paper 5, in a cross section orthogonal to the axial direction of the shaft portion 10 and the guide roller 18. This equalizes the states where the long paper 5*a* is sent from the roll paper 5 to the printer via the guide roller 18, and can inhibit a change in the printing state of the long paper 5*a* to stabilize printing quality.

Furthermore, the roll support device 1 of the first embodiment includes a plurality of types of second guide members 12A and 12B, which serve as the second guide members 12, having different positions of the regulation portions 12*b* in the axial direction X of the fixed portion 12*a* (see FIGS. 10A to 10D). The plurality of types of second guide members 12A and 12B includes those having different lengths of the fixed portions 12*a* in the axial direction X of the shaft portion 10.

Similarly to the plurality of types of second guide members 12A and 12B, although not illustrated, the roll support device 1 includes a plurality of types of third guide members, which serve as the third guide members 13. In the plurality of types of third guide members, at least one of a dimension of the fixed portion 13*a* in the axial direction X of the shaft portion 10 and a position of the regulation portion 13*b* in the axial direction X of the fixed portion 13*a*, is different.

Note that the number of each of the plurality of types of second guide members 12 and the plurality of types of third guide members 13, is not limited. The second guide member 12 and the third guide member 13 of the number capable of addressing the range of the widths of a plurality of types of roll paper 5 used in the roll support device 1, are provided.

Figure 10A:
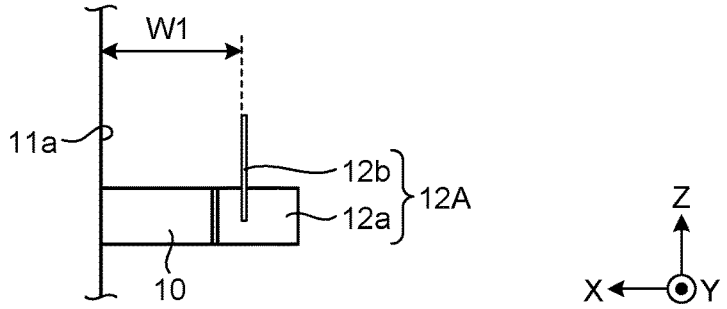
FIG. 10A is a front view illustrating an attached state of a second guide member in the roll support device of the first embodiment.
Figure 10B:
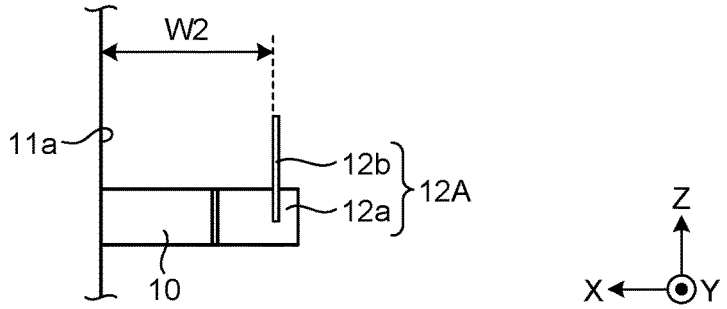
FIG. 10B is a front view illustrating another attached state of the second guide member in the roll support device of the first embodiment.
Figure 10C:
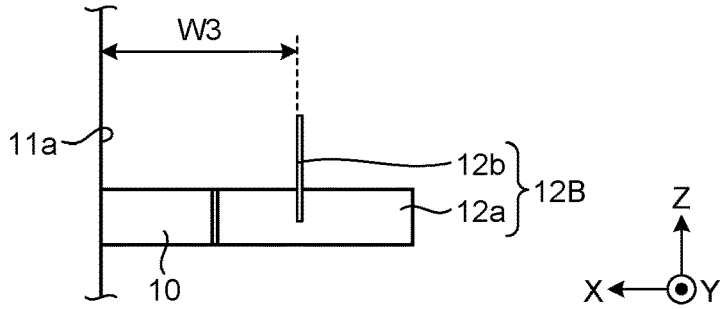
FIG. 10C is a front view illustrating an attached state of another second guide member in the roll support device of the first embodiment.
Figure 10D:
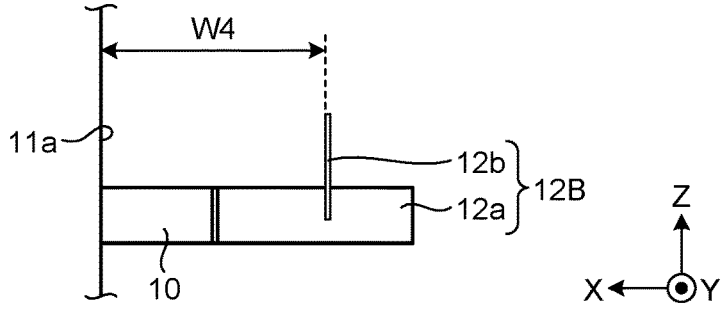
FIG. 10D is a front view illustrating another attached state of the other second guide member in the roll support device of the first embodiment.

Here, a state, in which a plurality of types of second guide members 12A and 12B is attached to the roll support device 1, will be described. FIG. 10A is a front view illustrating an attached state of a second guide member 12A in the roll support device 1 of the first embodiment. FIG. 10B is a front view illustrating another attached state of the second guide member 12A in the roll support device 1 of the first embodiment. FIG. 10C is a front view illustrating an attached state of another second guide member 12B in the roll support device 1 of the first embodiment. FIG. 10D is a front view illustrating another attached state of the other second guide member 12B in the roll support device 1 of the first embodiment.

When an end of the fixed portion 12*a* on a side close to the regulation portion 12*b* is fixed to the shaft portion 10 so as to come to the side of the shaft portion 10 as illustrated in FIG. 10A, the second guide member 12A can appropriately support the roll paper 5 having a width W1 while regulating the roll paper 5 in the axial direction X.

Furthermore, when the orientation of the second guide member 12A in the axial direction X of the shaft portion 10 is changed to an orientation opposite to the orientation in FIG. 10A, and an end of the fixed portion 12*a*, on a side away from the regulation portion 12*b*, is fixed to the shaft portion 10 so as to come to the side of the shaft portion 10 as illustrated in FIG. 10B, the second guide member 12A can appropriately support the roll paper 5, having a width W2, while regulating the roll paper 5 in the axial direction X.

Next, as illustrated in FIG. 10C, another second guide member 12B is attached to the shaft portion 10 instead of the second guide member 12A, so that the roll paper 5, having a width larger than the widths W1 and W2, can be addressed. When the end of the fixed portion 12*a*, on the side close to the regulation portion 12*b*, is fixed to the shaft portion 10 so as to come to the side of the shaft portion 10, the second guide member 12B can appropriately support the roll paper 5, having a width W3, while regulating the roll paper 5 in the axial direction X.

When the orientation of the second guide member 12B in the axial direction X of the shaft portion 10, is changed to an orientation opposite to the orientation in FIG. 10C, and the end of the fixed portion 12*a*, on the side away from the regulation portion 12*b*, is fixed to the shaft portion 10 so as to come to the side of the shaft portion 10 as illustrated in FIG. 10D, the roll paper 5, having a width W4, can be appropriately supported while being regulated in the axial direction X.

Similarly to the plurality of types of second guide members 12A and 12B, a plurality of types of third guide members (not illustrated) is selectively attached to the roll support device 1. One of the plurality of types of third guide members is fixed on the base 14 in a predetermined orientation, so that the position of the regulation surface 13*c* of the regulation portion 13*b* can be switched in accordance with the width of the roll paper 5.

Effects of First Embodiment

As described above, the roll support device 1 of the first embodiment includes the shaft portion 10, which supports the center hole 5*c* of the roll paper 5 (through hole of core 5*b*), the first guide member 11, with which the left end surface 5L of the roll paper 5 is in contact, the second guide member 12, which regulates the inner peripheral side of the right end surface 5R of the roll paper 5 in the axial direction X, and the third guide member 13, which regulates the outer peripheral side of the right end surface 5R of the roll paper 5 in the axial direction X. Thus, for example, the second guide member 12 is passed through the center hole 5*c* of the roll paper 5 to lower the roll paper 5 by the weight of the roll paper 5 itself. This allows the right end surface 5R of the roll paper 5 to be regulated in the axial direction by the second guide member 12 and the third guide member 13 without attaching/detaching the second guide member 12 and the third guide member 13. Therefore, an operation of attaching/ detaching the roll paper 5 to/from the roll support device 1 can be easily performed, and the operability at the time of replacing the roll paper 5 can be enhanced. Furthermore, according to the roll support device 1, the second guide member 12 and the third guide member 13 can be fixedly provided on the roll support device 1, so that the loss of the second guide member 12 and the third guide member 13 can be prevented.

Furthermore, in the roll support device 1 of the first embodiment, the height H of the second guide member 12 in the radial direction of the roll paper 5, supported by the shaft portion 10, is smaller than the inner diameter D of the center hole 5*c* of the roll paper 5. This allows the second guide member 12 to be smoothly passed through the center hole 5*c* of the roll paper 5, and allows the roll paper 5 to be easily supported by the shaft portion 10. Therefore, the operability at the time of replacing the roll paper 5 can be further improved.

Furthermore, in the roll support device 1 of the first embodiment, the sum of the radial upper range A1 of the right end surface 5R regulated by the second guide member 12 and the radial lower range A2 of the right end surface 5R regulated by the third guide member 13 is equal to or larger than the entire range A3 from the inner periphery to the outer periphery of the right end surface 5R in the radial direction of the roll paper 5 supported by the shaft portion 10. This allows the regulation surface 12*c* of the second guide member 12 and the regulation surface 13*c* of the third guide member 13 to cooperate with each other to regulate the radial portion of the right end surface 5R of the roll paper 5 from the inner periphery to the outer periphery, and allows the roll paper 5 to be appropriately regulated in the axial direction X.

Furthermore, each of the second guide member 12 and the third guide member 13 in the roll support device 1 of the first embodiment is provided such that each position in the axial direction X of the shaft portion 10 can be adjusted. Thus, the roll paper 5 can be appropriately regulated by the second guide member 12 and the third guide member 13 by appropriately adjusting and fixing each of the positions of the second guide member 12 and the third guide member 13 while the pieces of roll paper 5 having different widths can be supported on the shaft portion 10.

Furthermore, each of the second guide member 12 and the third guide member 13 in the roll support device 1 of the first embodiment includes the fixed portions 12*a* and 13*a*, which are fixed to an end of the shaft portion, and the regulation portions 12*b* and 13*b*, which extend along the radial direction of the roll paper 5 from the fixed portions 12*a* and 13*a*, and regulate the inner peripheral side of the right end surface 5R. Each of the second guide member 12 and the third guide member 13 is provided so as to be attached in an orientation opposite to the axial direction X of the shaft portion 10. Thus, the pieces of roll paper 5, having different widths, can be supported on the shaft portion 10, by attaching each of the second guide member 12 and the third guide member 13 on the shaft portion 10 after switching the orientation of the shaft portion 10 in the axial direction X, and the convenience of the roll support device 1 can be improved.

Furthermore, the roll support device 1 of the first embodiment includes a plurality of types of second guide members 12 and a plurality of types of third guide members 13, which have different positions of the regulation portions in the axial direction of the fixed portion. Thus, a plurality of types of roll paper 5, having different widths, can be supported on the shaft portion 10 by selectively using one of the plurality of types of second guide members 12 and one of the plurality of types of third guide members 13, and the convenience of the roll support device 1 can be further improved.

Second Embodiment

Figure 11:
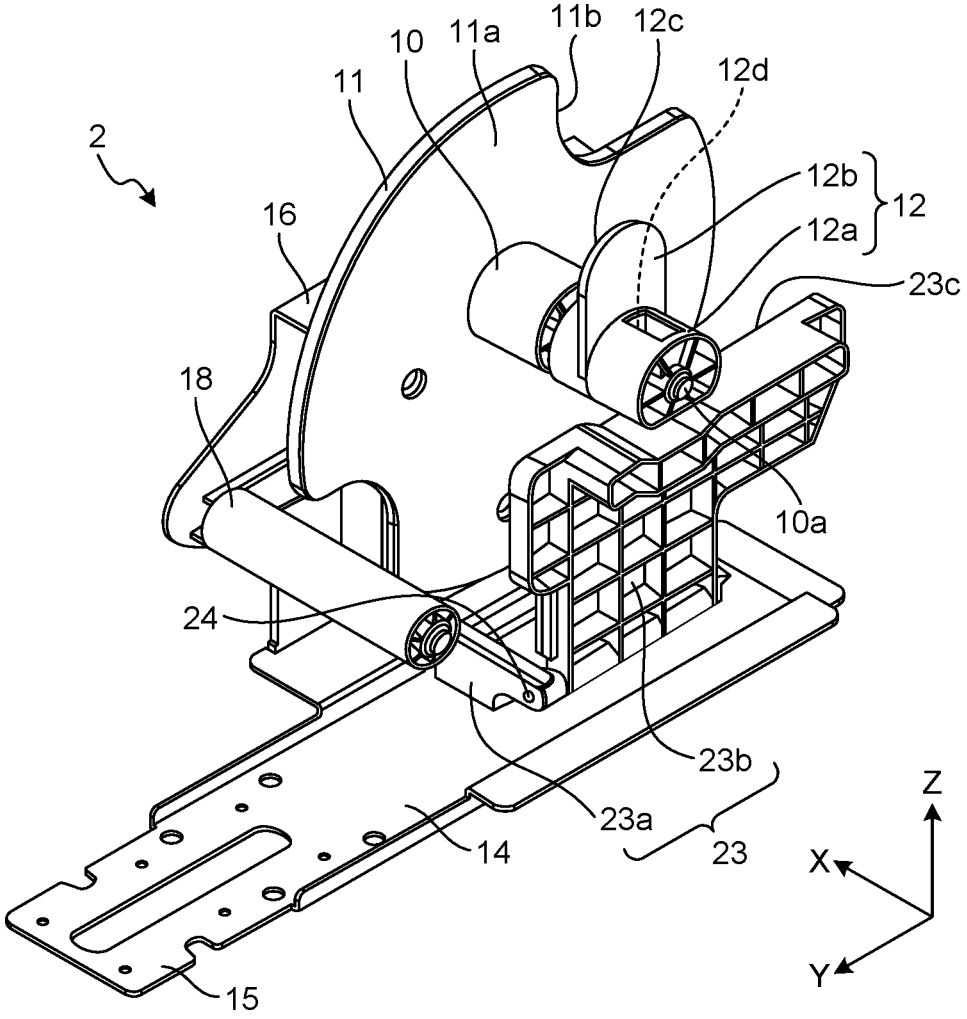
FIG. 11 is a perspective view illustrating a roll support device of a second embodiment from a right side.
Figure 12:
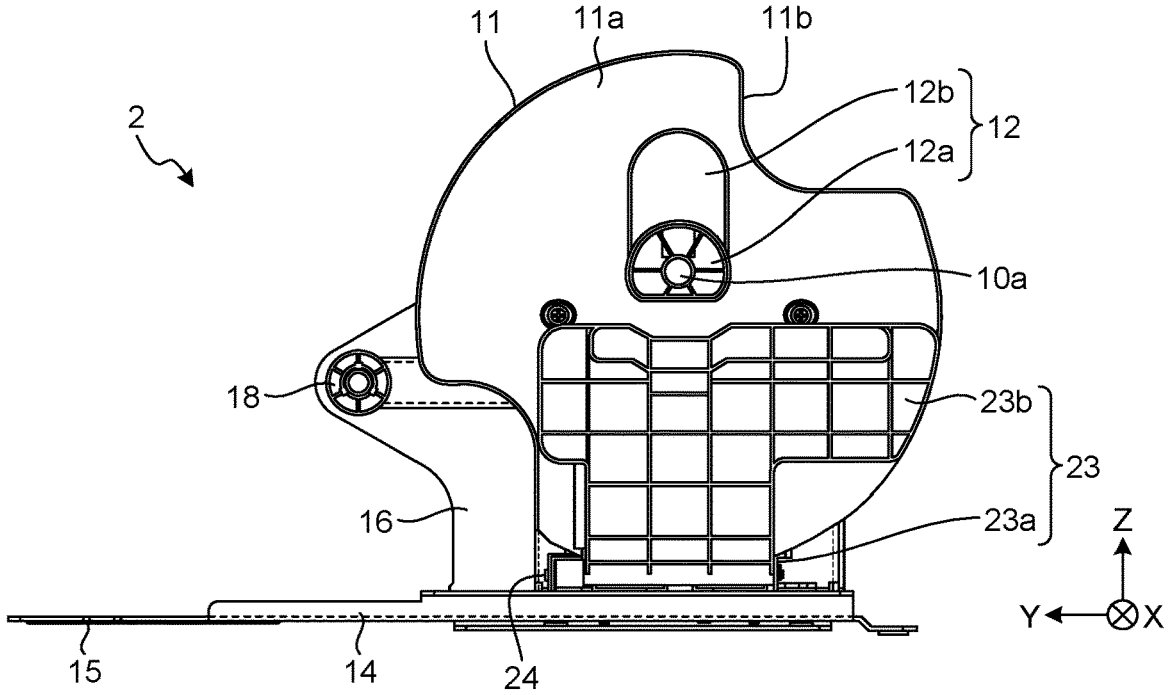
FIG. 12 is a right side view illustrating the roll support device of the second embodiment.

A second embodiment will be described below with reference to the drawings. In the second embodiment, the same reference signs as those in the first embodiment are attached to the same components as those in the first embodiment, and the description thereof will be omitted. The second embodiment is different from the first embodiment in that a regulation portion of a third guide member is turnably provided. FIG. 11 is a perspective view illustrating a roll support device of a second embodiment from a right side. FIG. 12 is a right side view illustrating the roll support device 1 of the second embodiment.

As illustrated in FIGS. 11 and 12, a roll support device 2 of the second embodiment includes a third guide member 23 that regulates the outer peripheral side of a right end surface 5R of the roll paper 5, supported by a shaft portion 10, in an axial direction X.

The third guide member 23 is disposed on the side of the right end surface 5R of the roll paper 5, supported by the shaft portion 10, and detachably provided on a base 14 below a second guide member 12. As illustrated in FIG. 11, the third guide member 23 includes a fixed portion 23*a*, which is fixed on the base 14, and a regulation portion 23*b*, which regulates the outer peripheral side of the right end surface 5R of the roll paper 5.

The regulation portion 23*b* is provided at the fixed portion 23*a* so as to turn around a turning shaft 24. The regulation portion 23*b* turns from a regulation position, at which the regulation portion 23*b* stands from the fixed portion 23*a* to follow the right end surface 5R of the roll paper 5, to a retraction position, at which the regulation portion 23*b* is separated from the right end surface 5R of the roll paper 5 to follow the base 14. A torsion coil spring (not illustrated), which biases the regulation portion 23*b* in a direction of turning from the retraction position to the regulation position, is provided around the turning shaft 24 in the fixed portion 23*a*.

The regulation portion 23*b* has a flat plate shape, which has a regulation surface 23*c* in contact with the right end surface 5R of the roll paper 5. The regulation portion 23*b* extends in the Z direction upward from the fixed portion 23*a* to the vicinity of the shaft portion 10, and extends along a Y-axis toward the rear of the roll support device 2 to the outer periphery of the roll paper 5. The regulation portion 23*b* of the third guide member 23 is in contact with the right end surface 5R from the inner periphery to the outer periphery on the lower side of the right end surface 5R of the roll paper 5. Therefore, the regulation portion 23*b* of the third guide member 23 secures a regulation surface 23*c* larger than that of the regulation portion 13*b* of the third guide member 13 in the first embodiment, so that the right end surface 5R of the roll paper 5 can be regulated more stably.

Furthermore, the regulation portion 23*b* is turnably provided at the fixed portion 23*a*, so that the roll paper 5 can be supported on the shaft portion 10 by turning the regulation portion 23*b* that secures the large regulation surface 23*c*. In other words, the large regulation surface 23*c* of the regulation portion 23*b* can be secured by turnably providing the regulation portion 23*b* at the fixed portion 23*a*.

Furthermore, the fixed portion 23*a* of the third guide member 23 is provided such that the fixing position of the fixed portion 23*a* on the base 14 can be adjusted in the axial direction X of the shaft portion 10, similarly to the above-described third guide member 13. The regulation surface 23*c* of the third guide member 23 is fixed at a position coinciding with that of the regulation surface 12*c* of the second guide member 12 in the axial direction X of the shaft portion 10.

Note that, although not illustrated, an engaging portion for engaging an upper end of the third guide member 23 with the second guide member 12, may be provided on the third guide member 23. Furthermore, the regulation portion 23*b* of the third guide member 23 may extend upward from the fixed portion 23*a* to the outer periphery of the upper end of the roll paper 5 in the height direction Z. Expanding the regulation surface 23*c* of the regulation portion 23*b* can further stabilize the regulation state of the roll paper 5 in the width direction (X direction). Also in this case, the position of the regulation surface 23*c* of the regulation portion 23*b* of the third guide member 23 coincides with the position of the regulation surface 12*c* of the second guide member 12.

(Attachment of Roll Paper)

Figure 13:
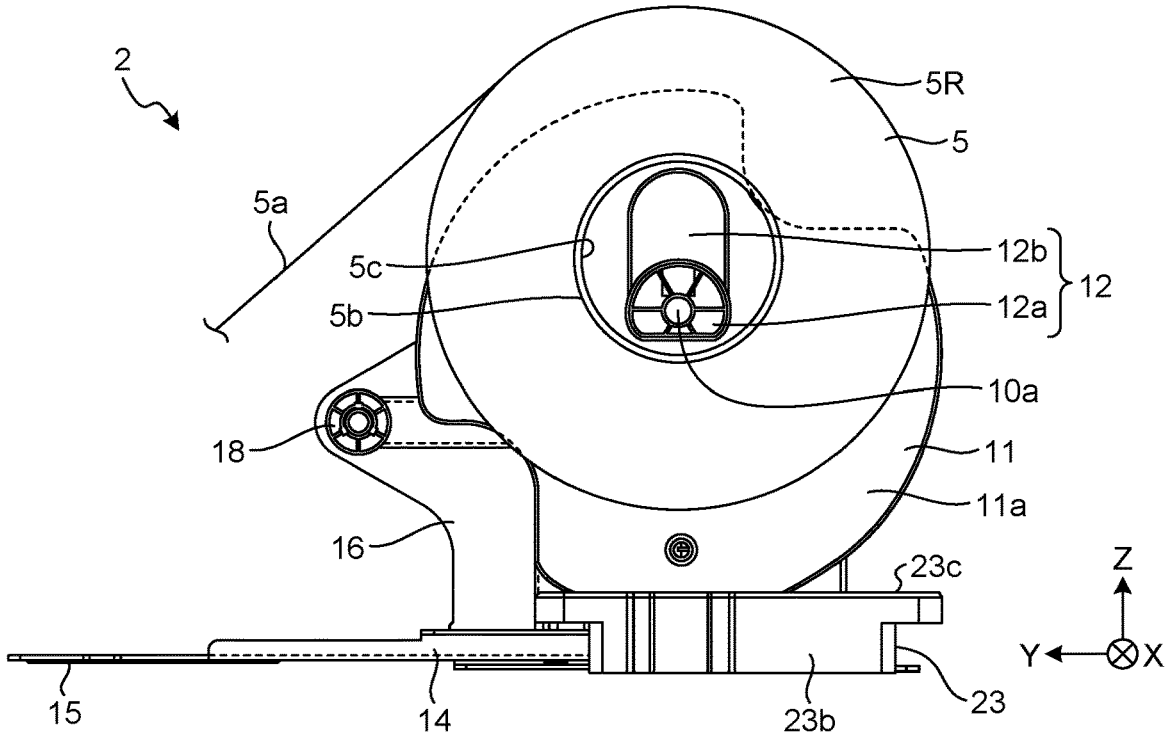
FIG. 13 is a right side view illustrating a state in which a shaft portion of the roll support device of the second embodiment is passed through a center hole of roll paper.
Figure 14:
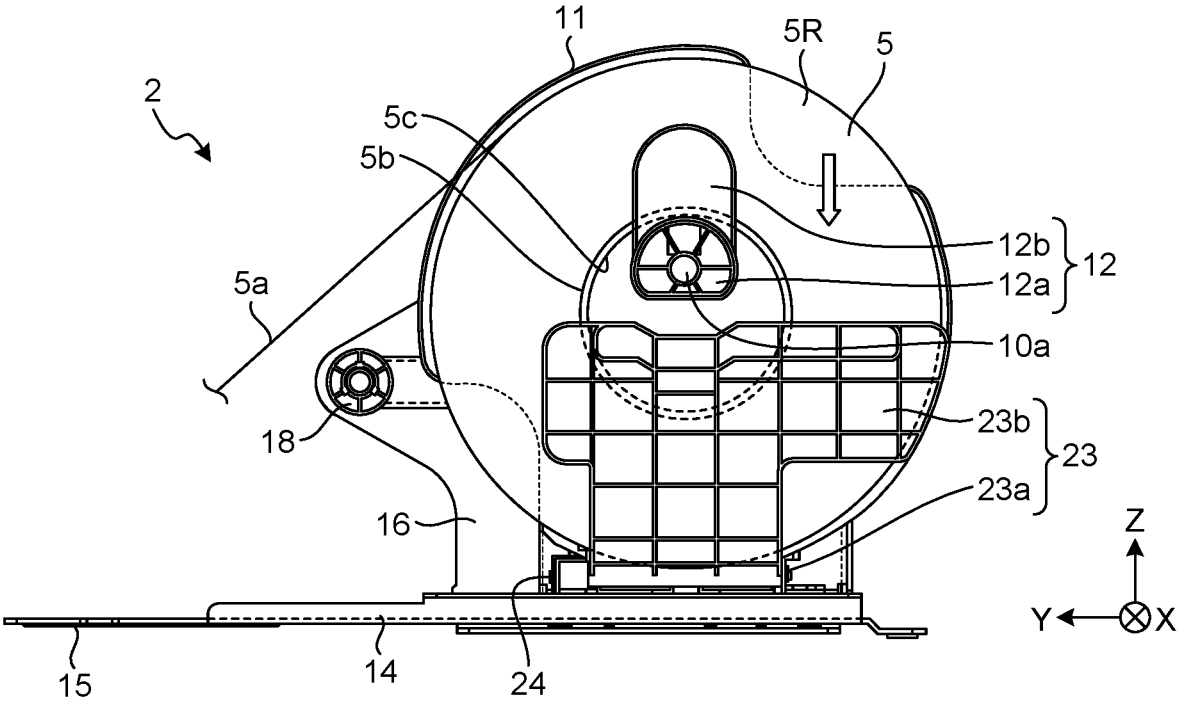
FIG. 14 is a right side view illustrating a state in which the roll paper is supported by the shaft portion of the roll support device of the second embodiment.
Figure 15:
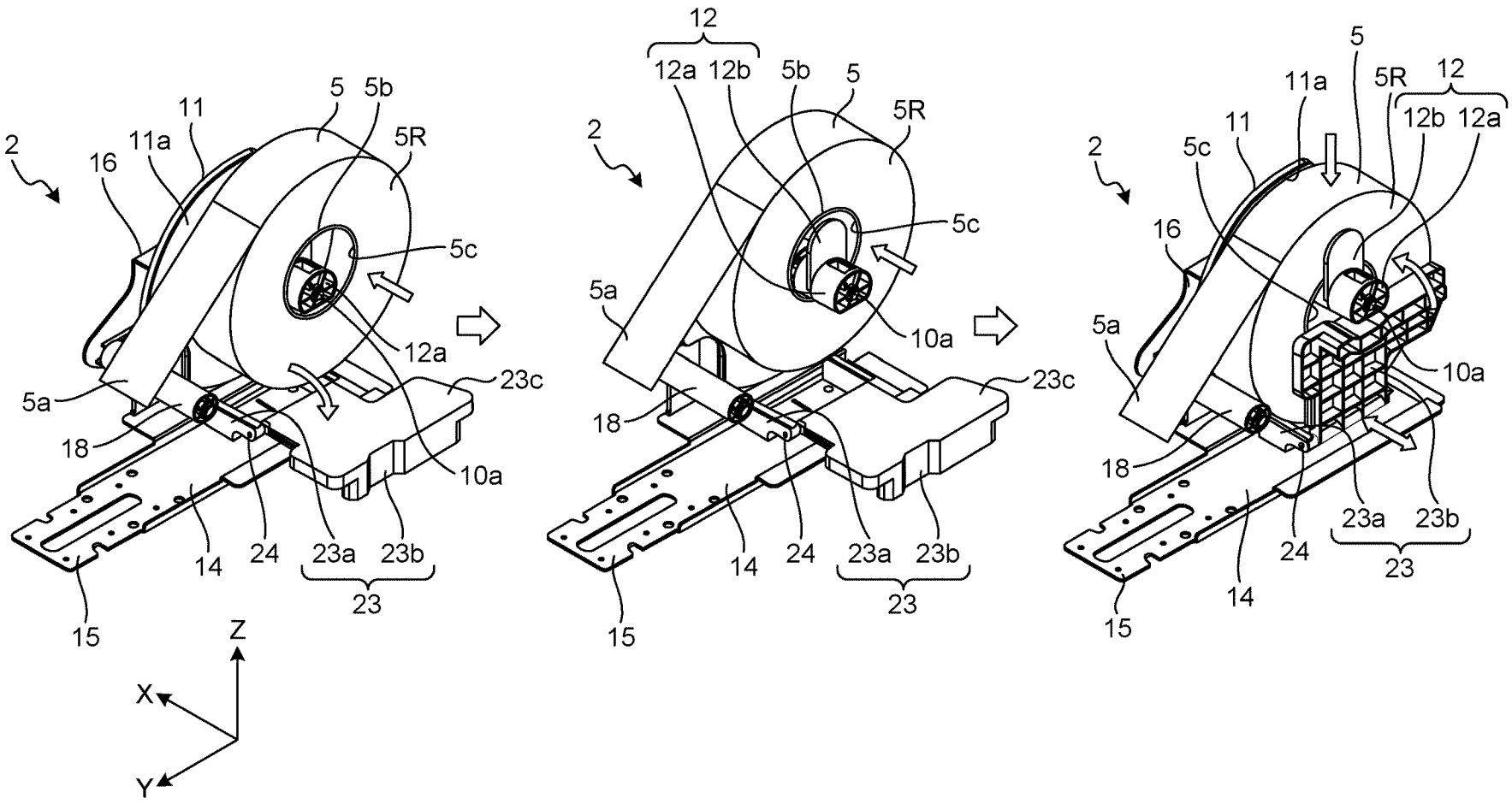
FIG. 15 is a perspective view illustrating a state in which the roll paper is attached to the shaft portion of the roll support device of the second embodiment.

FIG. 13 is a right side view illustrating a state in which the shaft portion 10 of the roll support device 2 of the second embodiment is passed through the center hole 5*c* of the roll paper 5. FIG. 14 is a right side view illustrating a state in which the roll paper 5 is supported by the shaft portion 10 of the roll support device 2 of the second embodiment. FIG. 15 is a perspective view illustrating a state in which the roll paper 5 is attached to the shaft portion 10 of the roll support device 2 of the second embodiment.

Also in the second embodiment, as illustrated in FIGS. 13 and 15, when the roll paper 5 is attached to the roll support device 2, the shaft portion 10 and the second guide member 12 are passed through the center hole 5*c* of the roll paper 5, and then the left end surface 5L of the roll paper 5 is made to abut on the reference surface 11*a* of the first guide member 11. Subsequently, as illustrated in FIGS. 13 and 14, the roll paper 5 is lowered by the weight of the roll paper 5 itself in the height direction Z with the left end surface 5L of the roll paper 5 being in contact with the reference surface 11*a* of the first guide member 11, so that the center hole 5*c* of the roll paper 5 is supported by the shaft portion 10.

Next, as illustrated in FIGS. 14 and 15, the regulation portion 23*b* is moved from the retraction position to the regulation position by turning the regulation portion 23*b* of the third guide member 23 with respect to the fixed portion. The regulation surface 23*c* comes in contact with the right end surface 5R of the roll paper 5, so that the regulation portion 23*b* that has moved to the regulation position regulates the right end surface 5R in the axial direction X.

Therefore, when the center hole 5*c* of the roll paper 5 is supported by the shaft portion 10, the regulation surface 12*c* of the second guide member 12 is in contact with the inner peripheral side of the right end surface 5R of the roll paper 5 while the regulation surface 23*c* of the third guide member 23 is in contact with the inner periphery to the outer periphery of the lower side of the right end surface 5R of the roll paper 5. Therefore, the left end surface 5L of the roll paper 5, whose center hole 5*c* is supported by the shaft portion 10, is regulated by the reference surface 11*a* of the first guide member 11 over the radial direction in the axial direction X. The roll paper 5 is regulated by the regulation surface 12*c* of the second guide member 12 and the regulation surface 23*c* of the third guide member 23 from the inner periphery to the outer periphery of the right end surface 5R in the axial direction X.

Effects of Second Embodiment

As described above, the third guide member 23 in the roll support device 2 of the second embodiment is provided so as to turn in a direction away from the right end surface 5R of the roll paper 5. As a result, the regulation portion 23*b* is turnably provided at the fixed portion 23*a*, so that the roll paper 5 can be supported on the shaft portion 10 by turning the regulation portion 23*b* that secures the large regulation surface 23*c*. That is, the large regulation surface 23*c* of the regulation portion 23*b* can be secured by turnably providing the regulation portion 23*b* at the fixed portion 23*a*. Therefore, the third guide member 23 can enhance the stability of the regulation state of the roll paper 5 while enhancing the operability at the time of replacing the roll paper 5.

Furthermore, also in the roll support device 2 of the second embodiment, similarly to the first embodiment, the right end surface 5R of the roll paper 5 can be regulated in the axial direction by the second guide member 12 and the third guide member 23 without attaching/detaching the second guide member 12 and the third guide member 23. Therefore, an operation of attaching/detaching the roll paper 5 to/from the roll support device 2 can be easily performed, and the operability at the time of replacing the roll paper 5 can be enhanced.

One aspect of a roll support device disclosed in the present application can enhance operability at the time of replacing a rolled medium.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A roll support device comprising:

a shaft portion that supports a center hole of a rolled medium in which a medium is wound;

a first guide member with which one end surface of the rolled medium in an axial direction of the shaft portion is in contact;

a base on which the first guide member is provided;

a second guide member that is provided on the shaft portion and regulates, in the axial direction, an inner peripheral side of another end surface of the rolled medium in the axial direction; and a third guide member that is provided on the base and regulates, in the axial direction, an outer peripheral side of the other end surface of the rolled medium supported by the shaft portion.

2. The roll support device according to claim 1, wherein the rolled medium, supported by the shaft portion, has a height of the second guide member in a radial direction smaller than an inner diameter of the center hole of the rolled medium.

3. The roll support device according to claim 1, wherein the second guide member is in contact with the other end surface from an inner peripheral edge to an inner peripheral side of the other end surface of the rolled medium, the third guide member is in contact with the other end surface from an outer peripheral edge to an outer peripheral side of the other end surface of the rolled medium, in the radial direction of the rolled medium supported by the shaft portion, a sum of a range in the radial direction of the other end surface, regulated by the second guide member, and a range in the radial direction of the other end surface, regulated by the third guide member, is equal to or larger than an entire range from an inner periphery to an outer periphery of the other end surface.

4. The roll support device according to claim 1, wherein each of the second guide member and the third guide member is provided such that each position in the axial direction of the shaft portion can be adjusted independently of each other.

5. The roll support device according to claim 4, wherein each of the second guide member and the third guide member includes:

a fixed portion that is fixed at an end of the shaft portion; and a regulation portion that extends along the radial direction of the rolled medium from the fixed portion, and regulates an inner peripheral side of the other end surface, and is provided so as to be attached in an orientation opposite to the axial direction of the shaft portion.

6. The roll support device according to claim 5, wherein there are provided a plurality of types of the second guide members and a plurality of types of the third guide members, which have different positions of the regulation portions in the axial direction of the fixed portion.

7. The roll support device according to claim 1, wherein the third guide member is provided so as to turn in a direction away from the other end surface of the rolled medium.

8. A roll support device comprising:

a shaft portion that supports a center hole of a rolled medium in which a medium is wound;

a first guide member with which one end surface of the rolled medium in an axial direction of the shaft portion is in contact;

a second guide member that is provided on the shaft portion and regulates, in the axial direction, an inner peripheral side of another end surface of the rolled medium in the axial direction; and a third guide member that regulates, in the axial direction, an outer peripheral side of the other end surface of the rolled medium supported by the shaft portion, wherein each of the second guide member and the third guide member includes:

a fixed portion that is fixed at an end of the shaft portion; and a regulation portion that extends along the radial direction of the rolled medium from the fixed portion, and regulates an inner peripheral side of the other end surface, each of the second guide member and the third guide member is provided such that each position in the axial direction of the shaft portion can be adjusted, and is provided so as to be attached in an orientation opposite to the axial direction of the shaft portion, and there are provided a plurality of types of the second guide members and a plurality of types of the third guide members, which have different positions of the regulation portions in the axial direction of the fixed portion.

* * * * *